US008162716B2

(12) United States Patent
Nuttall

(10) Patent No.: US 8,162,716 B2
(45) **Date of Patent: *Apr. 24, 2012**

(54) VEHICLE TRACK SET

(75) Inventor: Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 85 days.

This patent is subject to a terminal disclaimer.

(21) Appl. No.: 12/615,109

(22) Filed: Nov. 9, 2009

(65) Prior Publication Data

US 2010/0056015 A1 Mar. 4, 2010

Related U.S. Application Data

(63) Continuation of application No. 11/525,241, filed on Sep. 20, 2006, now Pat. No. 7,614,931.

(51) Int. Cl.
*A63H 17/44* (2006.01)

(52) U.S. Cl. ..... 446/444; 446/423

(58) Field of Classification Search ..... 446/171, 446/236, 237, 214, 423, 425–431, 444–448, 446/465, 467

See application file for complete search history.

(56) References Cited

U.S. PATENT DOCUMENTS

| | | | | |
|---|---|---|---|---|
| 2,634,128 | A | | 4/1953 | Reed |
| 2,742,164 | A | | 4/1956 | Francis |
| 2,992,598 | A | | 7/1961 | Einfalt |
| 3,281,985 | A | | 11/1966 | Einfalt |
| 3,457,668 | A | | 7/1969 | Genin |
| 3,593,454 | A | | 7/1971 | Einfalt |
| 3,653,626 | A | | 4/1972 | Tucker |
| 3,665,636 | A | | 5/1972 | Benson et al. |
| 3,703,989 | A | | 11/1972 | Tomiyama |
| 3,726,476 | A | | 4/1973 | Porter et al. |
| 3,789,538 | A | | 2/1974 | Spengler et al. |
| 4,128,964 | A | | 12/1978 | Ogasawara |
| 4,146,991 | A | * | 4/1979 | Sano ..... 446/430 |
| 4,291,488 | A | | 9/1981 | Orenstein |
| 4,582,500 | A | | 4/1986 | Hanson et al. |
| 4,585,166 | A | | 4/1986 | Stephens |
| 5,036,951 | A | | 8/1991 | Frangos |
| 5,586,923 | A | * | 12/1996 | Hippely et al. ..... 446/14 |
| 5,643,040 | A | | 7/1997 | Hippely et al. |
| 5,899,789 | A | | 5/1999 | Rehkemper et al. |
| 6,170,754 | B1 | | 1/2001 | Halford |
| 6,406,350 | B2 | | 6/2002 | Yoneda et al. |
| 6,510,956 | B2 | | 1/2003 | Therber |
| 6,679,751 | B1 | | 1/2004 | Maxwell et al. |
| 6,688,936 | B2 | | 2/2004 | Davis |
| 7,614,931 | B2 | * | 11/2009 | Nuttall ..... 446/444 |
| 2006/0159868 | A1 | | 7/2006 | Hoberman et al. |
| 2008/0070474 | A1 | * | 3/2008 | Nuttall ..... 446/444 |

OTHER PUBLICATIONS

Office Action for Chinese Patent Application No. 200710161416.1, dated Mar. 12, 2010, 8 pages including Chinese version and English translation.

* cited by examiner

*Primary Examiner* — Nini Legesse
(74) *Attorney, Agent, or Firm* — Edell, Shapiro & Finnan, LLC

(57) ABSTRACT

A toy vehicle track set. The track set includes toy roads sized for toy vehicles. The track set allows a toy vehicle to be raised and lowered to different elevations using one or more different mechanisms.

20 Claims, 6 Drawing Sheets

VEHICLE TRACK SET

CROSS-REFERENCE TO RELATED APPLICATION

This application claims priority to and the benefit of U.S. Non-Provisional patent application Ser. No. 11/525,241, filed Sep. 20, 2006, entitled "Toy Vehicle Track Set," the disclosure of which is incorporated by reference herein in its entirety.

BACKGROUND

Toy vehicles have been popular play items for many years. Scaled toy vehicles remain engaging toys for children and have found value as collector items for children and adults. Children enjoy a variety of different toy vehicles and continually seek new toy vehicles with which to play. Also, children enjoy finding new ways to play with toy vehicles. As such, track sets that are designed to facilitate toy vehicle play are popular play items. Track sets provide new toy vehicle play patterns which help retain the interest and excitement of children.

WRITTEN DESCRIPTION

The present disclosure is directed to a toy vehicle track set that includes reconfigurable features for changing the elevation of vehicle play. One such feature includes a spiraling track that serves as a road for a toy vehicle. The spiraling track has a first configuration in which it is generally flat and a second configuration in which it is vertically stretched into a path having the shape of a corkscrew. Another feature includes a lift that can hoist a toy vehicle to one or more different elevated levels. Although not required in all embodiments, the track set can be implemented as a portable set, which can be disassembled and/or folded to serve as a portable carrying case.

Figure 1A:
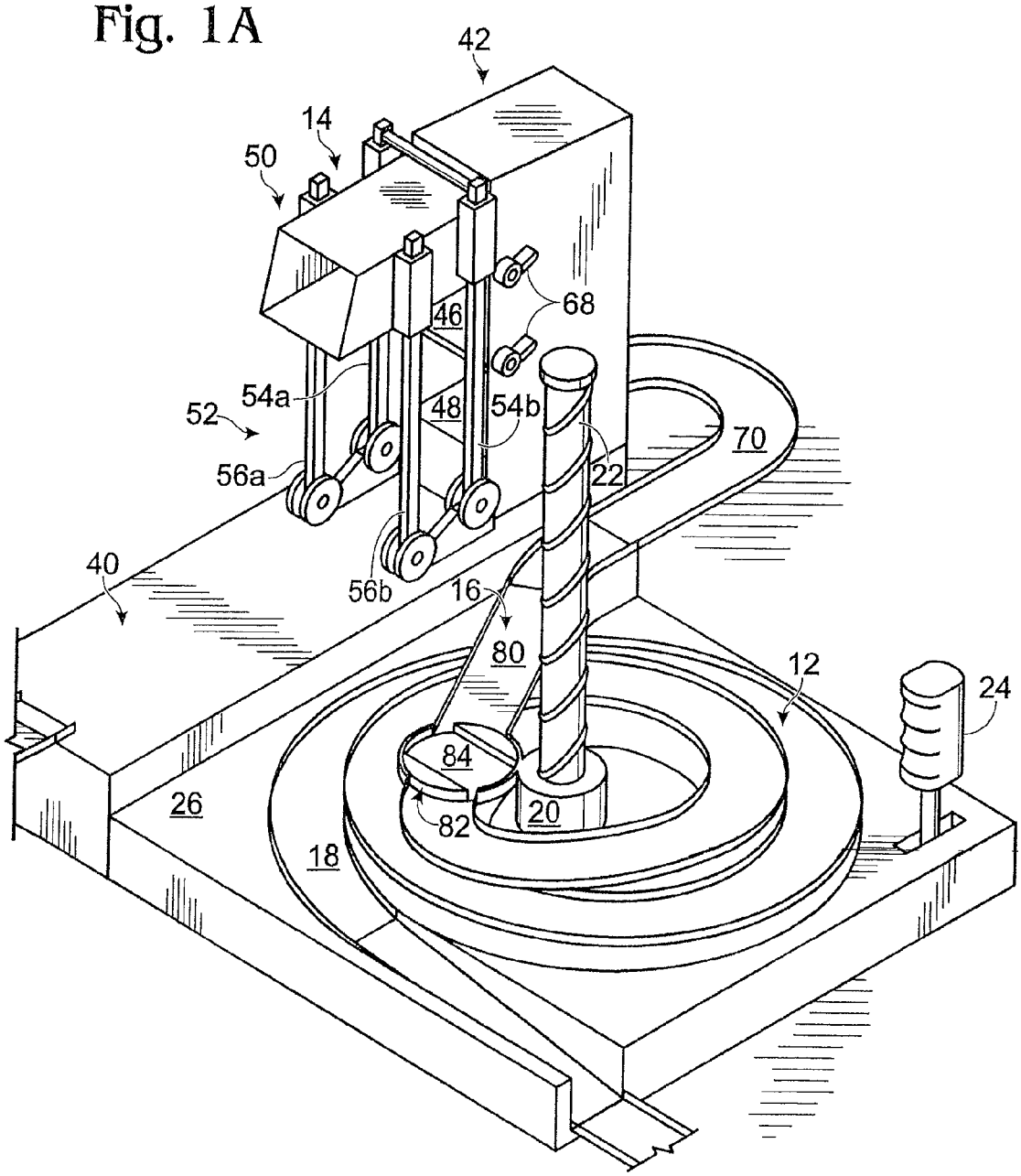
FIG. 1A shows a toy vehicle track set according to an embodiment of the present disclosure. The track set includes a spiraling track in a lowered position and a toy vehicle lift in an elevated position.
Figure 1B:
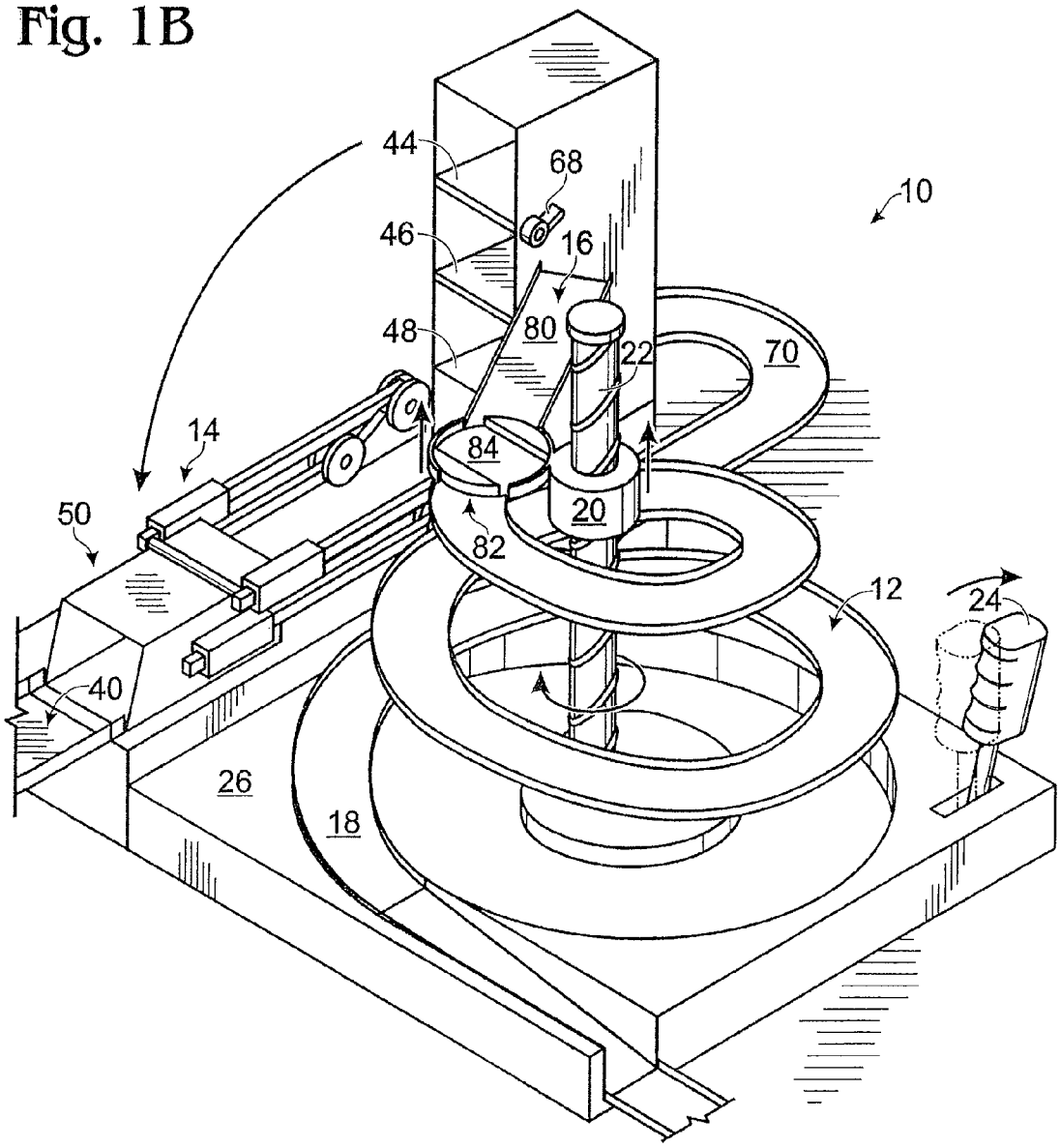
FIG. 1B shows the toy vehicle track set of FIG. 1A with the spiraling track in an elevated position and the toy vehicle lift in a lowered position.

FIGS. 1A and 1B show a nonlimiting example of a track set 10 that includes elevation changing features. In the illustrated embodiment, track set 10 includes a reconfigurable spiraling track 12 and a vehicle lift 14. These are two nonlimiting examples of elevation changing features that can be used to selectively change the elevation of play with a track set. In other embodiments, additional or alternative elevation changing features can be incorporated into a track set.

In FIG. 1A, spiraling track 12 is in a lowered configuration in which the spiraling track is generally flat. In other words, the spiraling track has a relatively mild grade (i.e., rise/run). In some embodiments, the grade in the lowered position can be less than 1:10 or even 1:20, although any grade that is substantially less steep than the elevated grade, as shown in FIG. 1B, is within the scope of this disclosure. The contrast between lowered and elevated grades is thought to improve the desirability of the track set.

As mentioned above, FIG. 1B shows spiraling track 14 in an elevated configuration in which the spiraling track has a corkscrew shape and a steeper grade (e.g., 1:9, 1:8, 1:7, 1:6, 1:5, 1:4, 1:3:1:2:1:1, or even steeper). In the illustrated embodiment, the track spirals from the inside out as it travels down, although this is not required. In other embodiments, the track can spiral from the outside in as it spirals down. In some embodiments the track may not spiral, but instead may take a path of a different shape.

For purposes of explanation, spiraling track 12 can be described as having an upper end 16 and a lower end 18. However, it should be understood that when in the lowered configuration, the upper end and the lower end may actually be at the same level or near the same level. When in the elevated configuration, a toy vehicle at the upper end of the track will have substantially more potential energy than a toy vehicle would have at the upper end of the track when the track is in the lowered configuration. Such potential energy can be used to cause the car to race down the corkscrew track with exciting and dramatic speed.

Figure 2:
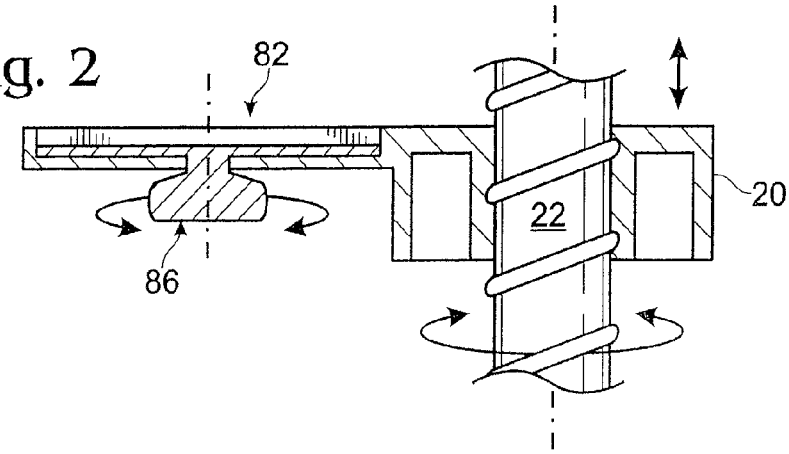
FIG. 2 shows a cross-sectional view of a threaded post and complimentarily threaded head arrangement that is used to move the spiraling track of FIG. 1A from a lowered position to an elevated position, and vice versa.

As shown in FIG. 2, the upper end of the track is operatively coupled to an internally threaded head 20, which engages a complementarily threaded post 22. By spinning the post, the threaded head can be moved up and down the post. Spiraling track 12 can be constructed out of a sufficiently flexible material so that when the head moves up or down the post, the spiraling track can adapt to accommodate the new change in elevation from the top to the bottom of the track. While a threaded post and head engagement is provided as a nonlimiting example of one mechanism for raising and lowering the track, other mechanisms are within the scope of this disclosure. Examples of other suitable elevation-changing mechanisms include a geared interface between the track and the post (similar to a rack and pinion), a telescoping post, or even a threaded arrangement in which the threads of the head move while the threads of the post remain stationary.

In the illustrated embodiment, threaded post 22 spins responsive to commands issued via a joystick 24. In the illustrated embodiment, joystick 24 can be moved in one direction to spin the post clockwise, and the joystick can be moved in the other direction to spin the post counterclockwise. In this way, the post can be raised and lowered. The joystick can be configured to control other aspects of the track set, such as vehicle lift 14, although this is not required. The track set may include one or more motors for performing such tasks, and such motors can be battery powered or powered via another source, such as an electric outlet.

As described above, the spiraling track can link head 20 to a base 26. As used herein, "base" is used to refer to the physical structure at the bottom of post 22, as well as all connected or adjacent structures that are near the same elevation level as the bottom of post 22.

As shown in FIGS. 1A and 1B, track set 10 includes a vehicle lift 14 that can hoist toy vehicles from a lower elevation 40 to one or more higher elevations. In the illustrated embodiment, lift 14 is configured to hoist the toy vehicle into one of three vertically arranged parking stalls in a vertically stacked garage 42. The garage includes an upper stall 44, a middle stall 46, and a lower stall 48. In other embodiments, a garage can include fewer or more stalls, and/or a different structure can be used to receive the hoisted cars (e.g., one or more vertically stacked ramps).

In the illustrated embodiment, lift 14 includes a cargo hold 50, which is supported by a pivoting parallelogram leg assembly 52. The parallelogram leg assembly can be used to help maintain the cargo hold in a substantially level orientation as it is hoisted from lower elevation 40 to one of the garage stalls. In this manner, a toy vehicle can remain in the cargo hold while it is hoisted.

The legs of the leg assembly may be mounted such that they may pivot relative to the structure to which they are mounted. In the illustrated embodiment, the leg assembly includes four legs that remain substantially parallel as the leg assembly pivots. In other embodiments, a leg assembly may include fewer legs or more legs. In the illustrated embodiment, two back legs 54A and 54B are pivotally mounted higher than two front legs 56A and 56B are pivotally mounted. This arrangement allows all legs to lie substantially flat when in the lowered position, as shown in FIG. 1B. However, this is a nonlimiting example of one suitable mounting arrangement, and other mounting arrangements are within the scope of this disclosure.

The parallelogram leg assembly can pivotally connect to the cargo hold so that the cargo hold can remain substantially level as it is raised and lowered. The pivot points can be positioned so that the front parallelogram leg(s) have approximately the same effective length as the rear parallelogram leg(s), thus allowing the front leg(s) to remain parallel with the back leg(s) as the leg assembly pivots.

Cargo hold 50 is slidably connected to the parallelogram leg assembly so that the effective height of the vehicle lift can be adjusted. For example, the cargo hold can be slid so that it is connected near the top of the parallelogram leg assembly for lifting a toy vehicle into upper stall 44 of garage 42. For lifting a toy vehicle into lower stall 48, the cargo hold can be slid so that it is connected near the bottom of the parallelogram leg assembly. The parallelogram leg assembly and cargo hold can be complimentarily configured so that the cargo hold can automatically be secured at one of several different heights. For example, the cargo hold may include a protrusion that fits in a complimentary detent of the leg assembly, thus temporarily supporting the cargo hold at that level. In other embodiments, the parallelogram leg assembly or the cargo hold can be configured to selectively secure the relative positioning at any selected height. For example, the cargo hold can include a user operable vice for gripping the leg assembly and holding the cargo hold at a selected height. Of course, these are nonlimiting examples, and other arrangements are possible.

The effective height of the cargo hold can be adjusted when the cargo hold is in the raised or lowered position. In the raised position, the cargo hold can be slid up and down on the leg assembly. In the lowered position, the cargo hold can be slid horizontally on the horizontally extending leg assembly. The track set may include one or more indicators that facilitate setting the position of the cargo hold on the leg assembly so as to facilitate alignment with one of the different garage stalls to which toy vehicles can be hoisted. As a nonlimiting example, the number "1" can be written at a position of lower elevation 40 to which the cargo hold can be slid if the leg assembly is to hoist a toy vehicle to the first level of garage 42. Likewise, the numbers "2" and "3" can be written in positions that facilitate alignment for hoisting a toy vehicle to the second and third levels.

Figure 3A:
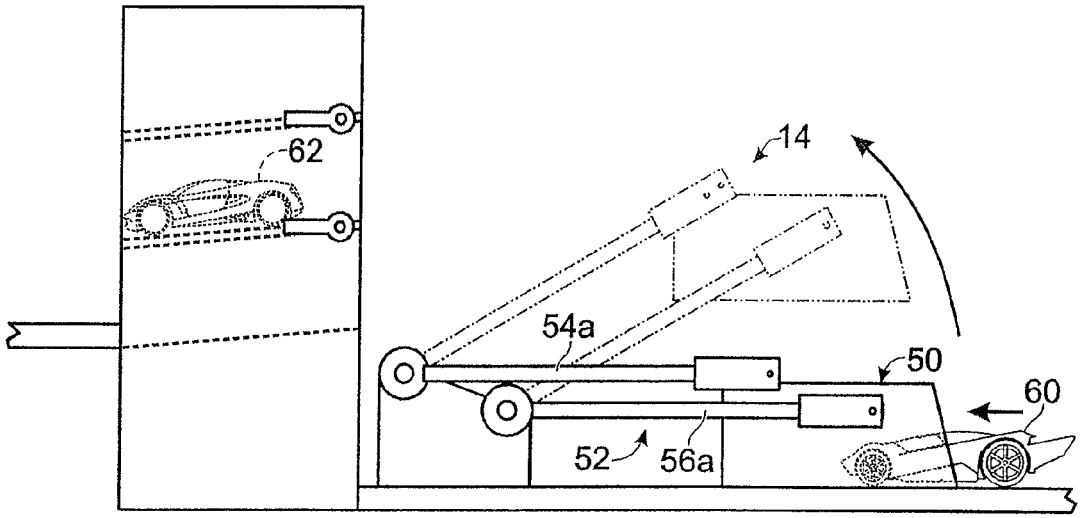
FIGS. 3A-3D show the toy vehicle lift of FIG. 1A lifting a first vehicle into an upper garage stall, picking up a second vehicle from an intermediate garage stall, and depositing the second vehicle in a lower garage stall.
Figure 3B:
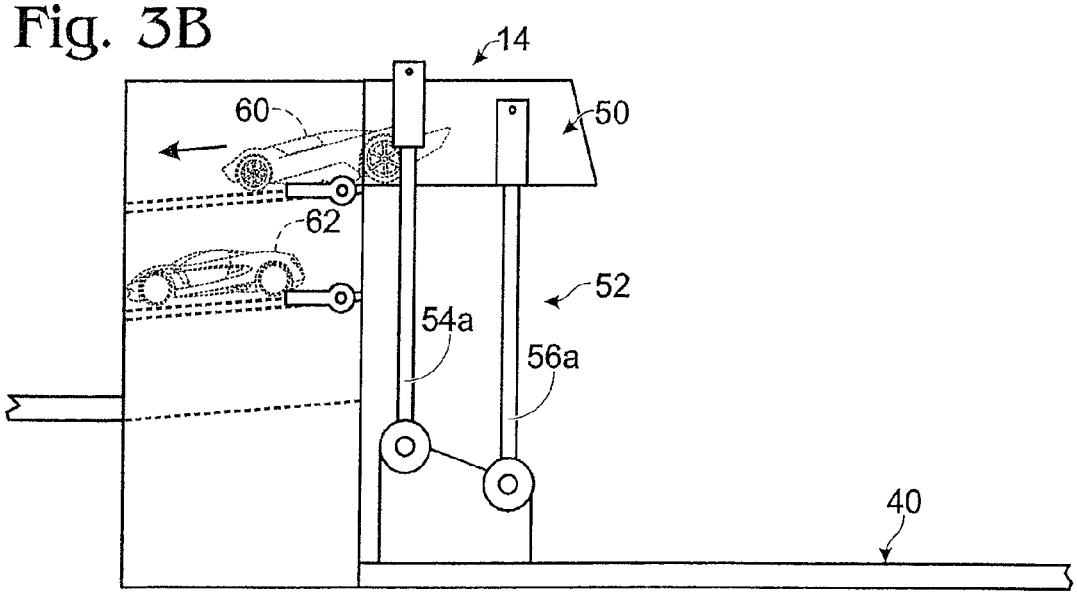

FIGS. 3A-3D show an exemplary pattern of play using lift 14. In FIGS. 3A and 3B, a toy vehicle 60 is hoisted from lower elevation 40 to upper stall 44. As shown in FIG. 3A, toy vehicle 60 can be rolled into the cargo hold when the cargo hold is in the lowered position. Once the toy vehicle is in the cargo hold, the cargo hold can be hoisted to lift the toy vehicle to garage 42. Prior to the toy vehicle entering the cargo hold, the cargo hold can be extended near the end of the leg assembly so that the cargo hold can reach upper stall 44 when the vehicle lift is moved into the raised position. Alternatively, the toy vehicle can first enter the cargo hold, and then the cargo hold can be extended to reach the upper stall. As described above, the cargo hold can be extended when the vehicle lift is in either the raised or lowered positions. However, in some embodiments the cargo hold can be extended only when in the raised position, and in some embodiments the cargo hold can be extended only when in the lowered position.

As shown in FIG. 3B, once in the raised position, toy vehicle 60 can be deposited in upper stall 44. In some embodiments, the toy vehicle can be manually pushed into a garage stall. In other embodiments, the cargo hold may have a mechanism for depositing the toy vehicle. As a nonlimiting example, the cargo hold can naturally be biased for the toy vehicle to roll out of the cargo hold, but with a gate that prevents the vehicle from rolling out. In such embodiments, the gate can be moved out of the way to allow the toy vehicle to roll into the upper stall when the cargo hold is properly positioned. As another example, the floor of the cargo hold can be configured to tilt, thus allowing the toy vehicle to roll out.

While an example of hoisting a vehicle to an upper stall is provided, it should be understood that the cargo hold can also be used to hoist a vehicle to another stall, or to lower a vehicle from any of the stalls to lower elevation 40.

Figure 3C:
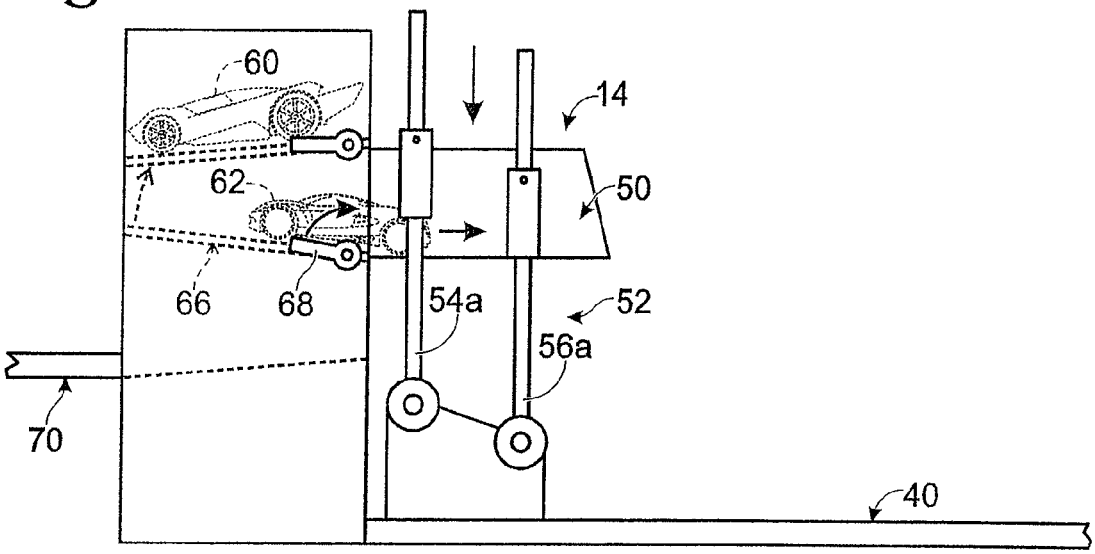

In FIG. 3C, the cargo hold is lowered to retrieve a toy vehicle 62 from middle stall 46. The middle stall includes a tiltable floor 66 which can be biased so as to prevent a toy vehicle from rolling out of the stall. The middle stall may also include an actuator 68 that tilts the floor, thus causing a vehicle to roll out of the stall. In some embodiments, a tiltable floor may be configured to automatically react to the cargo hold, such that the floor will automatically tilt to roll out a toy vehicle responsive to the cargo hold being positioned adjacent the stall when a toy vehicle is in the stall.

Figure 3D:
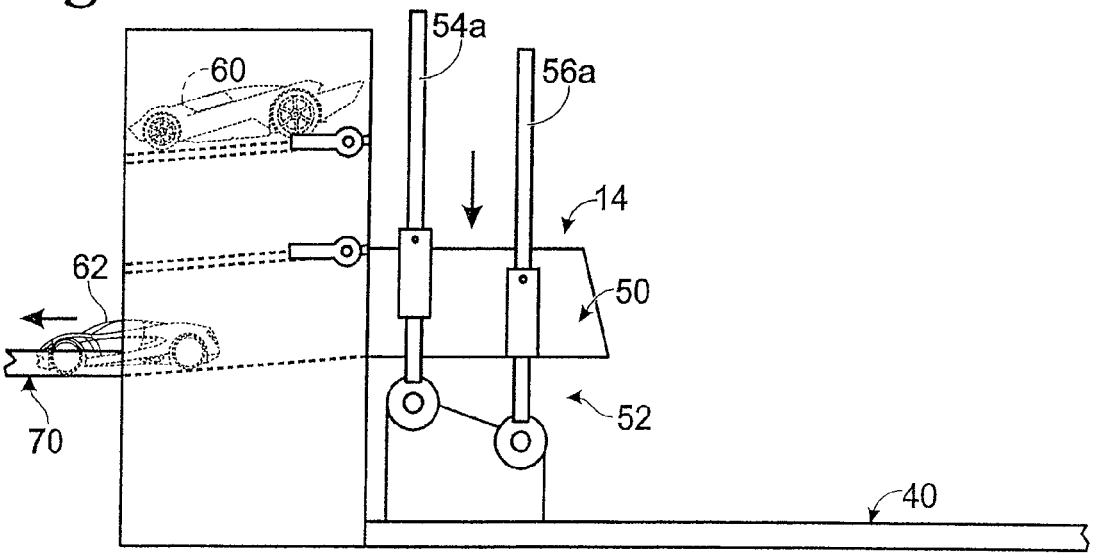

In FIG. 3D, the cargo hold is lowered so that toy vehicle 62 can be deposited into lower stall 48. In the illustrated embodiment, lower stall 48 connects to a ramp 70, and a toy vehicle deposited in the lower stall can automatically travel down the ramp responsive to gravity.

Figure 4A:
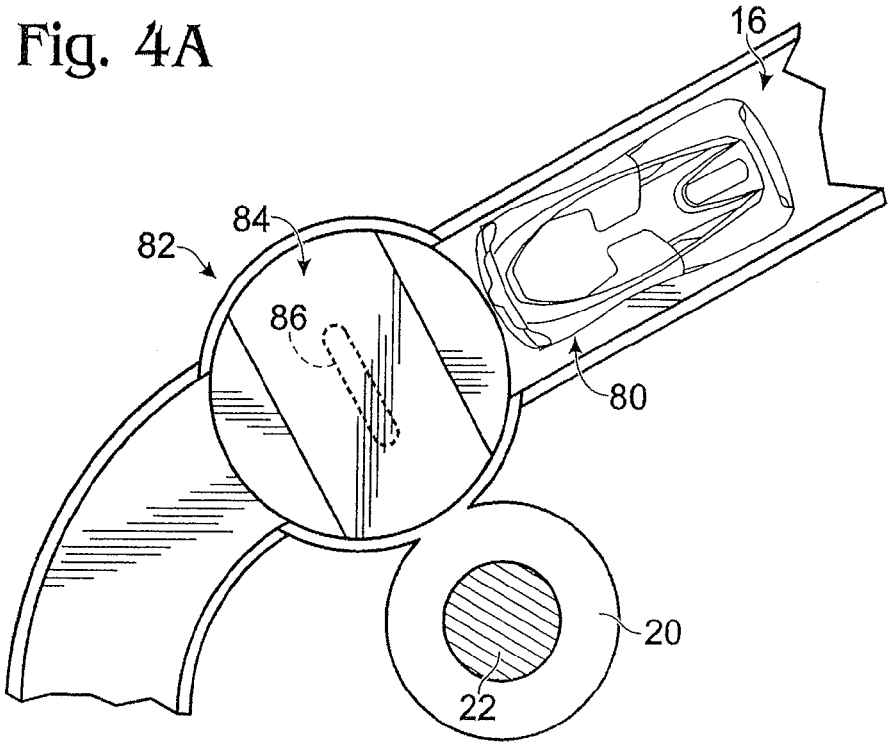
FIG. 4A shows an upper portion of the spiraling track of FIG. 1A with a turntable gate rotated to block a toy vehicle from rolling down the spiraling track.

As shown in FIG. 1A, ramp 70 leads from lower stall 48 to upper end 16 of spiraling track 12. When the spiraling track is in the lowered configuration, a car deposited in lower stall 48 can roll to the upper end of the spiraling track. The upper end of the track includes a holding area 80 at which a toy vehicle can rest. Furthermore, the upper end of the track can include a gate 82 that can selectively prevents a toy vehicle from rolling out of holding area 80 farther down the spiraling track. In the illustrated embodiment, gate 82 includes a turntable having a linear passage 84. A toy vehicle can roll through passage 84 when it is aligned with the spiraling track. If the passage is not aligned, the gate blocks the toy vehicle. As such, and as shown in FIG. 4A, the gate can be rotated to block a toy vehicle when the spiraling track is in the lowered configuration.

The spiraling track can be moved to the raised configuration after a toy vehicle has rolled onto holding area 80. As the spiraling track elevates, the toy vehicle in the holding area elevates, prevented from rolling down the spiraling track by gate 80.

Figure 4B:
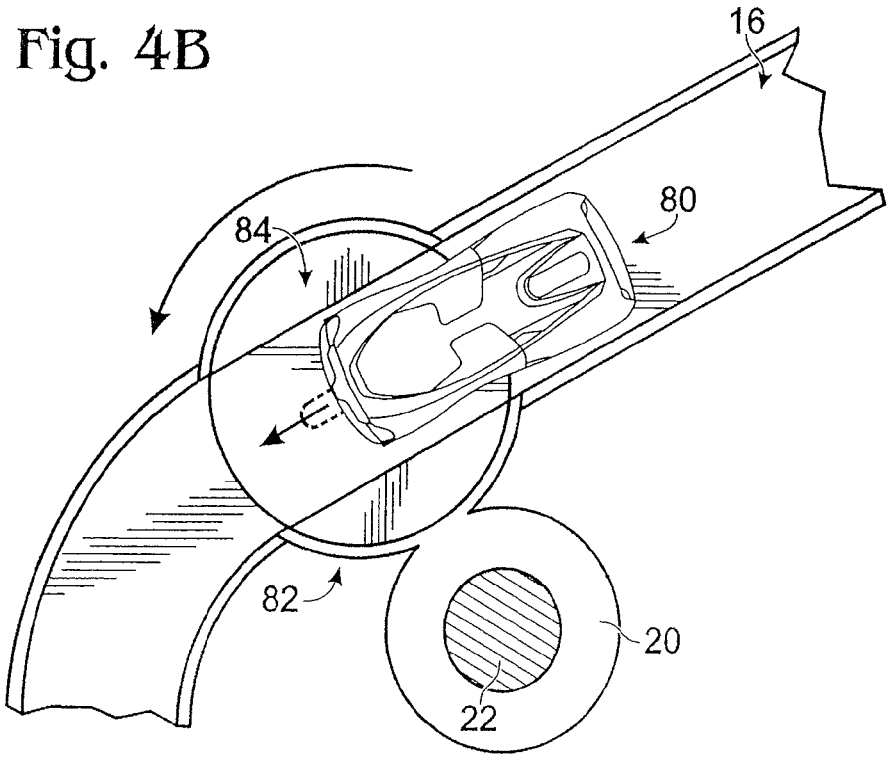
FIG. 4B shows the upper portion of the spiraling track in FIG. 4A with the turntable gate rotated to allow the toy vehicle to roll down the spiraling track.

As shown in FIG. 4B, gate 80 can be aligned with the spiraling track, thus enabling a toy vehicle to descend the spiraling track. Gate 80 can be manually rotated into alignment in some embodiments. For example, FIG. 2 shows a key 86 that is operatively connected to gate 80 such that gate 80 rotates when key 86 is rotated. In other embodiments, gate 80 can be mechanically controlled, such as via joystick 24. In some embodiments, the gate can be configured to automatically block a toy vehicle when the spiraling track is in the lowered position, and to allow a toy vehicle to pass when the spiraling track is in the raised position. For example, the gate may be mechanically linked to the treaded post such that the gate automatically rotates as the gate moves up the threaded post.

The above described play pattern is provided as a nonlimiting example of the types of play that are possible with the illustrated track set. It should be appreciated that many different play scenarios are available with the illustrated track set. Furthermore, various modifications can be made to the illustrated track set while remaining within the scope of the present disclosure. For example, two or more different spiraling tracks can be incorporated into a single track set, a vehicle lift may be used to elevate a toy vehicle to the top of an elevated spiraling track, etc.

Furthermore, additional or alternative features can be included with a track set. As nonlimiting examples, a track set may include a car wash station in which a car rotates on a turntable as the turntable is horizontally moved under simulated cleaning brushes and water sprays. As another example, a track set may include a simulated drive-in restaurant with a turnstile that spins when a car passes through. As another example, the track set may include a tire changing station that includes a robotic arm that simulates the removal and replacement of vehicle tires. As another example, the track set may include a car stereo store that includes toy vehicle platforms that cause a toy vehicle to tilt from side-to-side and forward-and-backward responsive to control from a joystick. As another example, the track set may include a car repair station that includes a robotic hand for clamping onto a toy vehicle and lifting it upside down, so as to grant access to simulated pneumatic tools. As another example, the track set may include a paint station with a simulated paint booth and paint sprayers. As yet another example, the track set may include a simulated gas station. Such features can be located at an exterior of base 26, in the area under an elevated spiraling track, and/or near vehicle lift 14.

One or more of the above described features, when present, can include lights and/or sounds to improve play value. For example, when the spiraling track is being elevated, a sound can be played to signify the lifting of the track and/or when the car lift is being-pivoted up to the garage a sound can be played. When a toy vehicle is driving down the spiraling track, a race car engine sound can be played. When a car is at the car stereo store, music can be played. When a car is at tire station or the repair station, toil sound can be played.

Figure 5A:
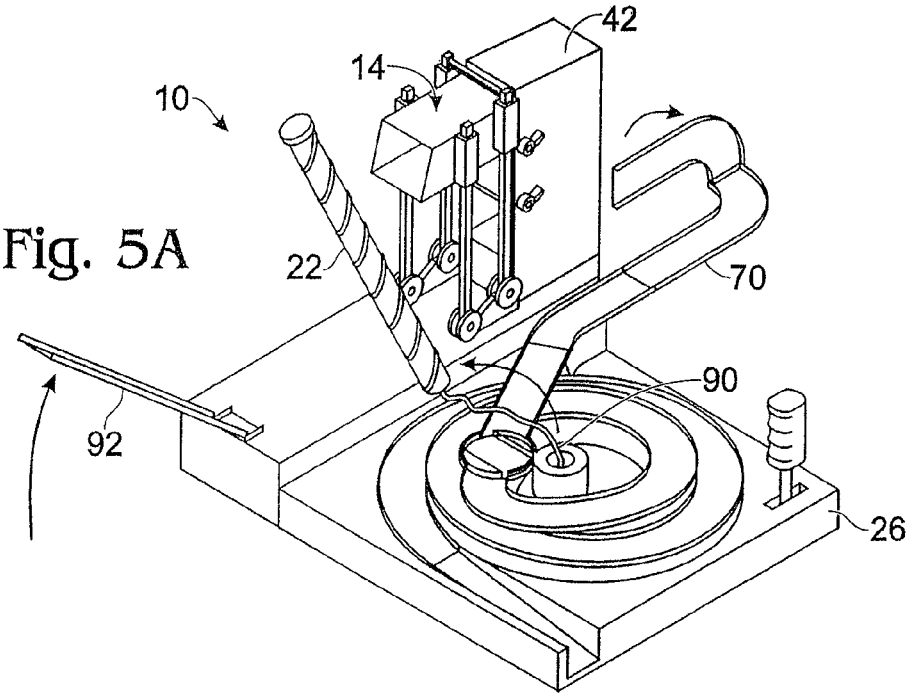
FIGS. 5A-5C show the toy vehicle track set of FIG. 1A being folded.
Figure 5B:
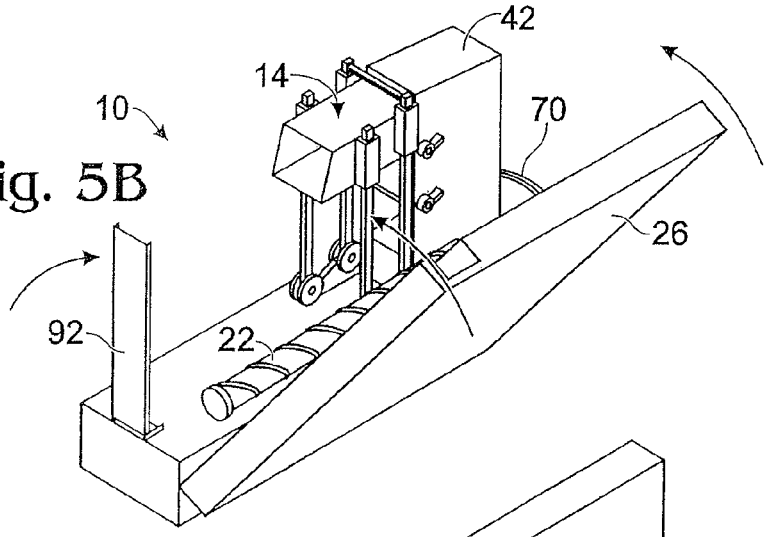
Figure 5C:
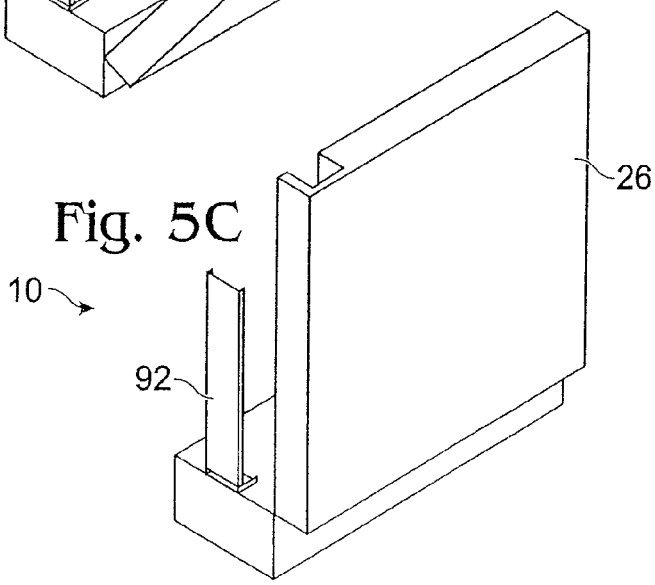

In some embodiments, post 22 can be detached from base 26, thus significantly reducing the vertical size of the track set and improving the portability of the track set. Such an embodiment is shown in FIGS. 5A-5C. In some embodiments, the post may include one or more joints that allow the post to fold, thus reducing its longest dimension and improving portability. In some embodiments, post 22 can be tethered to the base so that when it is disengaged from the base, it will not become lost.

As shown in FIGS. 5A-5C, track set 10 can be folded into a substantially flat structure for transport and storage. In the illustrated embodiment, post 22 is detached from base 26 and made to lie substantially flat with the base. The post is tethered to the base by a string 90. An extension 92 is folded up from the left to the right, towards vehicle lift 14. Ramp 70 is disconnected from garage 42, and is folded to move adjacent to the garage. Base 26 and all supported structures (e.g., the spiraling track) are folded toward the vehicle lift. In some embodiments, a handle may be included to facilitate transportation.

In the foregoing specification, the invention has been described with reference to specific embodiments thereof. It will, however, be evident that various modifications and changes can be made thereto without departing from the broader spirit and scope of the invention. The specification and drawings are, accordingly, to be regarded in an illustrative rather than a restrictive sense.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations and combinations are possible.

The following claims particularly point out certain combinations and subcombinations regarded as novel and nonobvious. These claims may refer to "a" or "a first" element or the equivalent thereof. Such claims should be understood to include incorporation of one or more such elements, neither requiring nor excluding two or more such elements. Further, ordinal numbers, such as first, second, and third, for identified elements or actions are used to distinguish between the elements and actions, and do not indicate a required or limited number of such elements or actions, nor a particular position or order of such elements or actions unless otherwise specifically stated. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A track set for toy vehicles, comprising:

a base;

a post coupled to the base; and a track coupled to the post, the track having a spiral configuration, the track being movable between a lowered configuration and a raised configuration relative to the base when the post rotates relative to the base.

2. The track set of claim 1, wherein the track extends around the post.

3. The track set of claim 1, wherein the post is removably coupled to the base.

4. The track set of claim 1, wherein the post rotates relative to the track.

5. The track set of claim 1, wherein the post is threaded, the rotation of the threaded post causing the track to move along the post and move relative to the base.

6. The track set of claim 1, further comprising:

an actuator coupled to the base, the actuator being manipulatable by a user to move the track between its lowered configuration and its raised configuration.

7. The track set of claim 1, further comprising:

a vehicle garage coupled to the base, the vehicle garage having a first vehicle receiving portion and a second vehicle receiving portion, the track being positionable to receive a toy vehicle from the vehicle garage.

8. A track set for toy vehicles, comprising:

a base;

a vehicle garage coupled to the base, the vehicle garage having a first stall defining a first vehicle receiving portion and a second stall defining a second vehicle receiving portion, the first stall being separate from the second stall; and a spiral track coupled to the base, the spiral track being adjustable and having a lowered configuration and a raised configuration, the track being positionable to receive a toy vehicle from the vehicle garage.

9. The track set of claim 8, wherein the spiral track receives the toy vehicle from the vehicle garage when the spiral track is in its lowered configuration.

10. The track set of claim 8, wherein the spiral track has an upper end and a lower end, the upper end of the spiral track being in communication with the vehicle garage when the spiral track is in its lowered configuration.

11. The track set of claim 8, further comprising:

a ramp positioned proximate to the vehicle garage, the spiral track being positioned proximate to the ramp in its lowered configuration, the toy vehicle being movable from the vehicle garage to the ramp and then to the spiral track.

12. The track set of claim 11, wherein the spiral track can be raised from its lowered configuration with the toy vehicle positioned thereon.

13. The track set of claim 8, further comprising:

an actuator coupled to the base, the actuator being manipulatable by a user to move the spiral track between its lowered configuration and its raised configuration.

14. The track set of claim 13, wherein the actuator causes the post to rotate relative to the base.

15. The track set of claim 8, further comprising:

a lift configured to move the toy vehicle from a position proximate to the base to a position proximate to the first vehicle receiving portion or the second vehicle receiving portion.

16. The track set of claim 15, wherein the lift includes a leg assembly and a hold that is movable along the leg assembly, the hold being positionable proximate to the first vehicle receiving portion and to the second vehicle receiving portion.

17. A track set for toy vehicles, comprising:

a foldable base;

a post coupled to the base, the post being rotatable relative to the base; and a spiral track coupled to the post, the spiral track being movable along the post between a lowered configuration and a raised configuration when the post rotates relative to the base, the spiral track being in its lowered configuration and the post decoupled from the base when the base is folded.

18. The track set of claim 17, wherein the post is threaded and the spiral track includes a head coupled to the post, the post and the head being complimentarily threaded.

19. The track set of claim 17, further comprising:

a vehicle garage coupled to the base, the vehicle garage including a first vehicle receiving portion and a second vehicle receiving portion, the spiral track being positionable relative to the vehicle garage to receive a toy vehicle from the vehicle garage.

20. The track set of claim 19, wherein the spiral track can receive the toy vehicle from the vehicle garage when the spiral track is in its lowered configuration.

* * * * *